US007481668B2

(12) United States Patent
Chiang

(10) Patent No.: US 7,481,668 B2
(45) Date of Patent: Jan. 27, 2009

(54) FLAT CABLE CONNECTOR

(75) Inventor: Chin-Chih Chiang, Taipei (TW)

(73) Assignee: Jess-Link Products Co., Ltd., Taipei (TW)

( * ) Notice: Subject to any disclaimer, the term of this patent is extended or adjusted under 35 U.S.C. 154(b) by 0 days.

(21) Appl. No.: 12/014,163

(22) Filed: Jan. 15, 2008

(65) Prior Publication Data

US 2008/0305678 A1 Dec. 11, 2008

(30) Foreign Application Priority Data

Jun. 6, 2007 (TW) ..... 96209278 U

(51) Int. Cl.
*H01R 12/24* (2006.01)

(52) U.S. Cl. ..... 439/492; 439/493; 439/494; 439/495

(58) Field of Classification Search ..... 439/492, 439/493, 494, 495
See application file for complete search history.

(56) References Cited

U.S. PATENT DOCUMENTS 4,040,704 A * 8/1977 Huber ..... 439/400
6,932,648 B1 * 8/2005 Chiu et al. ..... 439/607
2006/0134969 A1 * 6/2006 Takaku et al. ..... 439/495

* cited by examiner

*Primary Examiner*—Tho D Ta

(57) ABSTRACT

A flat cable connector includes an insulating base. Both ends of the insulating base have a protruding buckling end respectively. The buckling ends on both ends and a plate body of the insulating base form an accommodating space for accommodating the flat cable therein. The insulating base is provided thereon with a plurality of penetrating holes for penetrating the plate body. Both surfaces of the insulating base are connected with an upper conductive cover and a lower conductive cover respectively. The upper conductive cover and the lower conductive cover are provided with a plurality of fixing terminals. After the upper conductive cover is connected with the insulating base, the fixing terminals of the upper conductive cover abut against the flat cable. After the lower conductive cover is connected with the insulating base, the fixing terminals of the lower conductive cover abut against the flat cable via the penetrating holes, thereby blocking the electromagnetic interference generated by the flat cable connector.

20 Claims, 4 Drawing Sheets

FLAT CABLE CONNECTOR

BACKGROUND OF THE INVENTION

1. Field of the Invention

The present invention relates to a connector, and in particular to a connector for connecting to a flat cable.

2. Description of Prior Art

A common electronic device is constituted of various electronic elements. In order to facilitate the transmission of signals or data among respective electronic elements, a flat cable of flexible printed circuit is often used as a bridge for the transmission of signals or data among respective electronic elements.

A conventional flat cable connector often has an adapter serving as a connecting means for each electronic element, so that the flat cable can be electrically connected to each electronic element smoothly. Usually, the adapter has an insulating base. The base has an accommodating space thereon for accommodating the flat cable. The base is connected with a casing, thereby sandwiching the flat cable therebetween while exposing terminals of the flat cable. Since the electro-magnetic waves generated when the flat cable is powered is taken into consideration, the casing is usually made of metallic materials and abuts against the flat cable directly, thereby generating an electro-magnetic shielding effect for the flat cable. Thus, the normal operation of other surrounding electronic elements can be protected from being affected by the electro-magnetic interference.

In prior art, since the fact that the normal operation of other electronic elements will be affected by the electro-magnetic waves generated when the flat cable is powered has been taken into consideration, the casing made of metallic materials is employed to generate an electro-magnetic shielding effect. However, such a protection is merely feasible for single surface. In other words, the electro-magnetic waves generated in the other surface of the flat cable cannot be shielded by means of the metallic casing. As a result, the flat cable still generates an electro-magnetic interference to affect the functions of other electronic elements in transmitting signals or data. Thus, this will affect the normal operation of an electronic device and become an important issue for those skilled in this art.

SUMMARY OF THE INVENTION

In order to overcome the above-mentioned drawbacks, the present invention is to provide a flat cable connector having double electro-magnetic protections. Both ends of an adapter of the connector are connected with a casing made of metallic materials respectively, and fixing terminals extending from the casing abut against an inserted flat cable directly, thereby generating an electro-magnetic shielding effect for the flat cable connector. Via this arrangement, the electro-magnetic waves generated when the flat cable is powered can be obviated, thereby blocking the electro-magnetic interference.

The present invention is to provide a flat cable connector comprising an insulating base. Both ends of the insulating base have a protruding buckling end respectively. The buckling ends on both ends of the insulating base and a plate body of the insulating base form an accommodating space for accommodating the flat cable therein. The insulating base is provided thereon with a plurality of penetrating holes for penetrating the plate body. Both surfaces of the insulating base are connected with an upper conductive cover and a lower conductive cover respectively. The upper conductive cover and the lower conductive cover are provided with a plurality of fixing terminals. After the upper conductive cover is connected with the insulating base, the fixing terminals of the upper conductive cover abut against the flat cable directly. After the lower conductive cover is connected with the insulating base, the fixing terminals of the lower conductive cover abut against the flat cable via the penetrating holes, thereby blocking the electro-magnetic interference generated by the flat cable connector.

DETAILED DESCRIPTION OF THE INVENTION

The technical contents of the present invention will be described with reference to the accompanying drawings.

Figure 1:
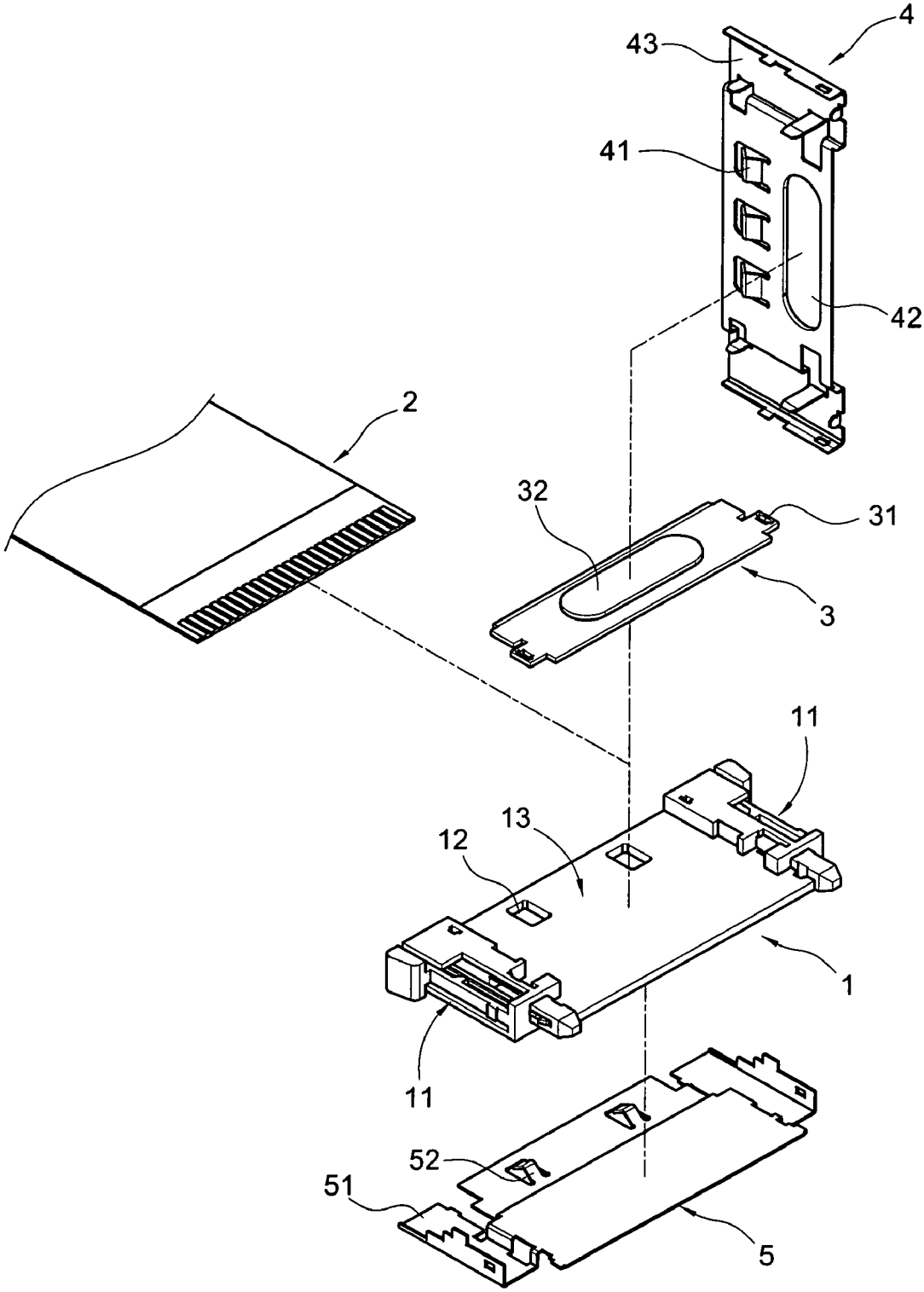
FIG. 1 is an exploded perspective view showing the structure of the present invention.
Figure 2:
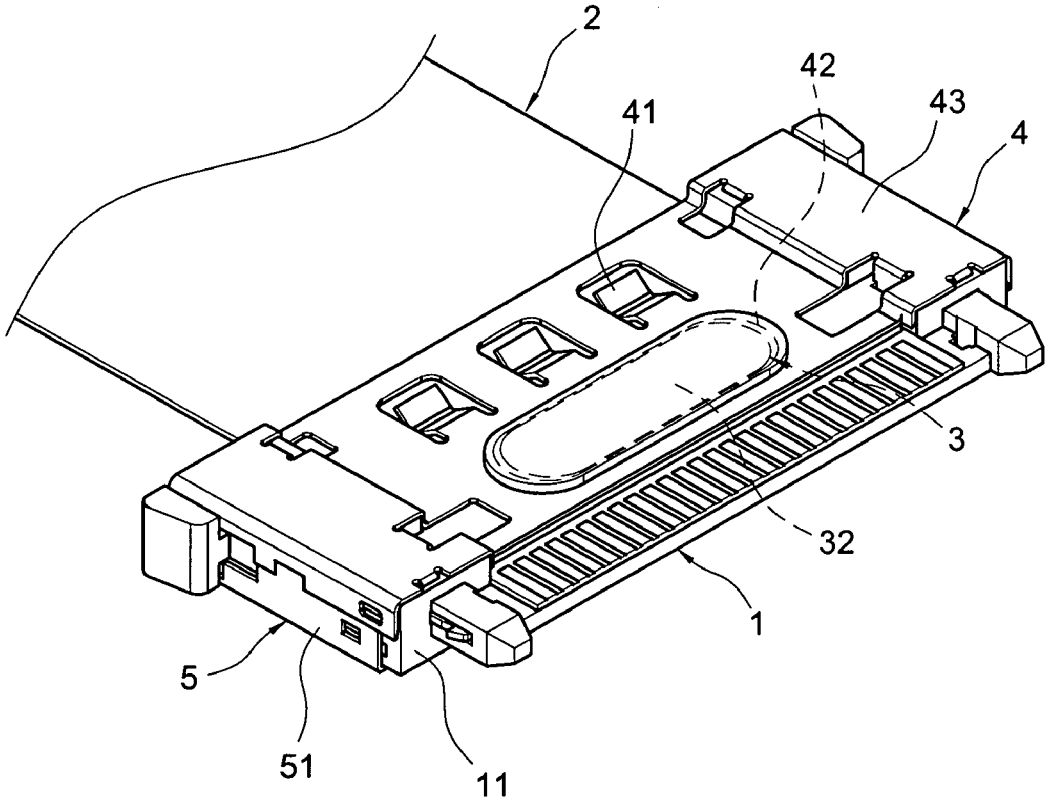
FIG. 2 is a top perspective view of the present invention.
Figure 3:
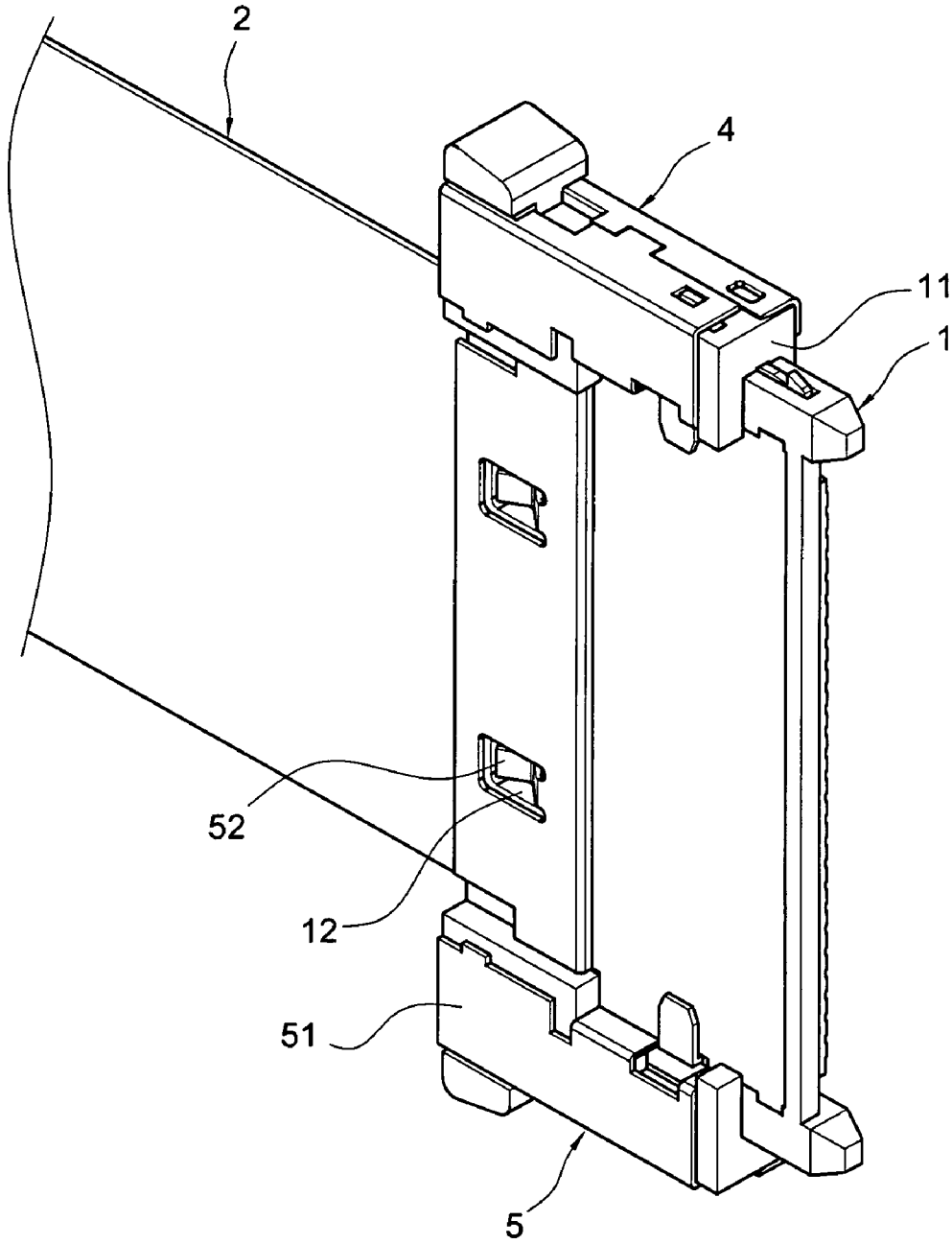
FIG. 3 is a bottom perspective view of the present invention.

FIG. 1 is an exploded perspective view showing the structure of the present invention, and FIG. 2 is a top perspective view of the present invention. As shown in these figures, the adapter includes an insulating base 1. Both ends of the insulating base 1 have a protruding buckling end 11 respectively that is symmetric with each other. A surface of the insulating base 1 is provided thereon with at least one penetrating holes 12. In the present embodiment, there is a plurality of penetrating holes 12. Further, the insulating base 1 and the buckling ends 11 protruding from both ends thereof form an accommodating space 13, thereby accommodating the flat cable 2. Further, a pressing plate 3 is disposed on a position corresponding to that of the accommodating space 13, thereby pressing the flat cable 2 and fixing it in the accommodating space 13. Both ends of the pressing plate 3 have a connecting end 31 respectively that is secured to the buckling end 11 on each end of the insulating base 1. Further, an upper plate surface of the pressing plate 3 is provided with a protruding block 32. In the present embodiment, the profile of the protruding block 32 has an elliptic shape With reference to FIG. 1 again, the upper and lower plate surfaces of the insulating base 1 are connected to an upper conductive cover 4 and a lower conductive cover 5 respectively, thereby generating an electro-magnetic shielding effect for the adapter of the connector. The upper conductive cover 4 covers the accommodating space 13 of the insulating base 1 completely, while it presses and fixes the flat cable 2 and the pressing plate 3. The surface of the upper conductive cover 4 contacting with the flat cable 2 has at least one fixing terminals 41 that are formed by means of bending. In the present embodiment, there is a plurality of fixing terminals. When the upper conductive cover 4 is connected with the insulating base 1, the plurality of fixing terminals 41 abut against the flat cable 2. Further, on the same surface as the fixing terminal 41, an accommodating trough 42 is provided thereon near the plurality of fixing terminals 41. The shape and position of the accommodating trough 42 corresponds to those of the protruding block 32 of the pressing plate 3 exactly. After the upper conductive cover 4 is connected with the insulating base 1, the protruding block 32 is exactly accommodated in the accommodating trough 42, so that the pressing plate is further secured. As shown in the top view of FIG. 2, both ends of the upper conductive cover 4 have a buckling trough 43 respectively that is to be connected with the buckling end 11 of the insulating base 1. Further, both ends of the lower conductive cover 5 have a buckling trough 51 respectively. When the lower conductive cover 5 is connected with the other surface of the insulating base 1, the buckling troughs 51 are connected with the buckling ends 11 of the insulating base 1. The surface of the lower conductive cover 5 connected to the insulating base 1 is provided thereon with at least one fixing terminals 52 that are formed by means of bending. In the present embodiment, there is a plurality of fixing terminals 52. Further, the number of the fixing terminals 52 is identical to that of the penetrating holes 12. The positions of the fixing terminals 52 of the lower conductive cover 5 correspond to those of the penetrating holes 12 of the insulating base 1 exactly. After the lower conductive cover 5 is connected with the insulating base 1, each fixing terminal 52 is exactly accommodated in the penetrating hole 12, so that the fixing terminals 52 abut against the flat cable 2, as shown in the bottom perspective view of FIG. 3.

Figure 4:
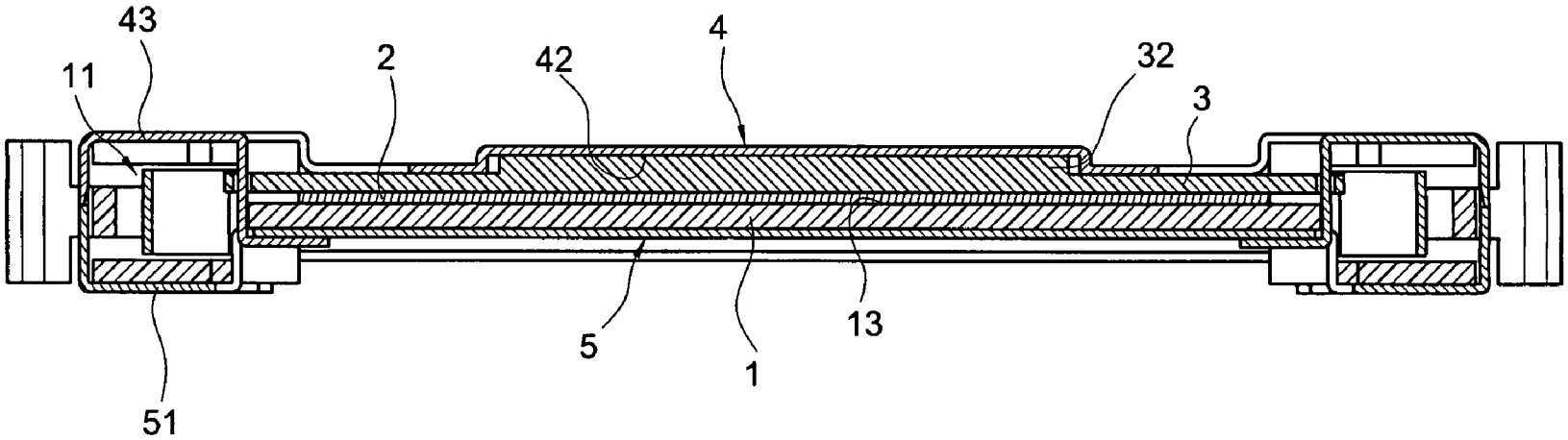
FIG. 4 is a cross-sectional view showing the structure of the present invention.

Please refer to FIG. 4, and it is a cross-sectional view showing the structure of the present invention. As shown in this figure, the adapter of the flat cable connector of the present invention utilizes the pressing plate 3 and the upper conductive cover 4 to fix the flat cable 2 on the insulating base 1, while the fixing terminals 41 provided on the upper conductive cover 4 abut against the flat cable directly. Further, the fixing terminals 52 of the lower conductive cover 5 abut against the flat cable directly via the penetrating holes 12 provided on the insulating base 1. As a result, the upper conductive cover 4 and the lower conductive cover 5 generate a double effect of shielding the electro-magnetic waves for the flat cable 2, thereby blocking the electro-magnetic waves generated by the flat cable 2.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A flat cable connector for connecting to a flat cable, comprising:

an insulating base, both ends of the insulating base having a protruding buckling end respectively, each buckling end and a plate body of the insulating base forming an accommodating space for accommodating the flat cable therein, the insulating base being provided thereon with a plurality of penetrating holes for penetrating the plate body;

an upper conductive cover, both ends of the upper conductive cover having a buckling trough respectively to be connected with the buckling end of the insulating base, the upper conductive cover pressing the flat cable in the accommodating space, the upper conductive cover being provided thereon with at least one first fixing terminal for abutting against the flat cable; and a lower conductive cover connected to another surface of the insulating base, both ends of the lower conductive cover having a buckling trough respectively to be connected with the buckling end of the insulating base, the lower conductive cover being provided thereon with at least one second fixing terminal, the second fixing terminal penetrating through the penetrating hole and abutting against the flat cable after the connection of the lower conductive cover and the insulating base is performed.

2. The flat cable connector according to claim 1, wherein a pressing plate is further provided between the insulating base and the upper conductive cover, the pressing plate is connected in the accommodating space of the insulating base so as to press the flat cable in the accommodating space.

3. The flat cable connector according to claim 2, wherein a surface of the pressing plate has a protruding block, the upper conductive cover having an accommodating trough, the protruding block is accommodated in the accommodating trough when the upper conductive cover presses the pressing plate.

4. The flat cable connector according to claim 2, wherein both ends of the pressing plate have a connecting end respectively for buckling the buckling end on each side of the insulating base.

5. The flat cable connector according to claim 1, wherein the first and the second fixing terminals are bent.

6. The flat cable connector according to claim 3, wherein the protruding block has an elliptic profile.

7. The flat cable connector according to claim 6, wherein a major-axis direction of the elliptic profile of the protruding block is parallel to a length direction of the pressing plate.

8. The flat cable connector according to claim 3, wherein the accommodating trough is located at an upper side of the the pressing plate, and the at least one first fixing terminal is located at a lateral side of the pressing plate for abutting against the flat cable directly.

9. A flat cable connector for connecting to a flat cable, comprising:

an insulating base having a plurality of penetrating holes penetrating therethrough;

a pressing plate positioned at an upper surface of the insulating base and cooperated with the insulating base for holding the flat cable therebetween, the pressing plate having a protruding block;

an upper conductive cover positioned at an upper surface of the pressing plate, the upper conductive cover having at least one first fixing terminal for abutting against the flat cable and an accommodating trough; wherein the protruding block extends upwards into the accommodating trough; and a lower conductive cover connected to a lower surface of the insulating base, the lower conductive cover being provided thereon with at least one second fixing terminal, the at least one second fixing terminal penetrating through the penetrating hole for abutting against the flat cable.

10. The flat cable connector according to claim 9, wherein the protruding block has an elliptic profile.

11. The flat cable connector according to claim 10, wherein the elliptic profile of the protruding block has a major-axis arranged in a direction parallel to a length direction of the pressing plate.

12. The flat cable connector according to claim 9, wherein both ends of the insulating base have a protruding buckling end respectively, each buckling end and a plate body of the insulating base forming an accommodating space for accommodating the flat cable and the pressing plate therein.

13. The flat cable connector according to claim 12, wherein the pressing plate is secured in the accommodating space via engagement of the protruding block in the accommodating trough.

14. The flat cable connector according to claim 13, wherein both ends of the upper conductive cover have a buckling trough respectively to be connected with the buckling end of the insulating base; both ends of the lower conductive cover have a buckling trough respectively to be connected with the buckling end of the insulating base.

15. The flat cable connector according to claim 14, wherein the upper conductive cover and the lower conductive cover together enclose a perimeter of the insulating base.

16. A flat cable connector for connecting to a flat cable, comprising:

an insulating base having a plurality of penetrating holes penetrating therethrough;

a pressing plate cooperated with the insulating base for holding the flat cable therebetween;

a first conductive cover positioned at a first side of the insulating base, the first conductive cover having at least one first fixing terminal for abutting against the flat cable;

a second conductive cover connected to a second side of the insulating base, the second conductive cover being provided thereon with at least one second fixing terminal, the at least one second fixing terminal penetrating through the penetrating hole for abutting against the flat cable; and one arm extending from the first conductive cover, the arm passing through the pressing plate and hooking at the second conductive cover.

17. The flat cable connector according to claim 16, wherein a free end of the arm extends through the pressing plate and the second conductive cover, and is bent to hook at the second conductive cover.

18. The flat cable connector according to claim 16, wherein the pressing plate has a protruding block extending away from the insulating base into one of the first conductive cover and the second conductive cover.

19. The flat cable connector according to claim 18, wherein an accommodating trough is provided on one of the first conductive cover and the second conductive cover, and the protruding block is retained in the accommodating trough.

20. The flat cable connector according to claim 19, wherein an additional arm extends from the first conductive cover, passes through the pressing plate and hooks at the second conductive cover; the protruding block extends between the arm and the additional arm.

* * * * *